US005454469A

United States Patent [19]

Budny et al.

[11] Patent Number: 5,454,469

[45] Date of Patent: Oct. 3, 1995

[54] LENS BOX

[75] Inventors: Thomas F. Budny, Novato, Calif.; Bruce Dalrymple, Loganville, Ga.; Robert J. Hellinger, Upland, Calif.

[73] Assignee: Malnove, Inc., Omaha, Nebr.

[21] Appl. No.: 233,137

[22] Filed: Apr. 26, 1994

[51] Int. Cl.[6] ..... B65D 85/38; B65D 85/48; B65B 43/08

[52] U.S. Cl. ..... 206/316.1; 53/456; 206/5; 206/454; 229/109

[58] Field of Search ..... 229/109, 110; 206/316.1, 303, 5, 445, 449, 454; 53/456

[56] References Cited

U.S. PATENT DOCUMENTS

| | | | |
|---|---|---|---|
| 1,968,660 | 7/1934 | Towell . | |
| 1,968,861 | 7/1934 | Towell . | |
| 2,307,076 | 1/1943 | Ray . | |
| 2,372,312 | 3/1945 | Buttery . | |
| 2,706,592 | 4/1955 | Schaller | 229/109 X |
| 2,819,833 | 1/1958 | Sauer | 229/109 |
| 2,925,213 | 2/1960 | Zukoski | 229/109 X |
| 3,122,298 | 2/1964 | Seger . | |
| 3,944,072 | 3/1976 | Budlington et al. | 229/109 X |
| 4,765,534 | 8/1988 | Zion et al. | 229/109 |
| 4,793,546 | 12/1988 | Nunn | 229/109 |
| 4,796,756 | 1/1989 | Ott | 206/454 |
| 5,178,275 | 1/1993 | Fitzgerald et al. | 53/456 X |
| 5,263,634 | 11/1993 | Korine . | |
| 5,333,732 | 8/1994 | Budny et al. | 206/316.1 |

FOREIGN PATENT DOCUMENTS

| | | | |
|---|---|---|---|
| 0085244 | 4/1991 | Japan | 229/109 |

*Primary Examiner*—Bryon P. Gehman
*Attorney, Agent, or Firm*—John A. Beehner

[57] ABSTRACT

A lens box for safe storage and transportation of optical lens blanks having vertically spaced apart top and bottom panels; two side walls, opposite closure panels and a plurality of gussets therebetween, all connected to the top and bottom panels and defining an enclosure space therebetween. The gussets are inclined upwardly and inwardly from the bottom panel, tangentially contacting the lens blank restricting the vertical and horizontal movement of the lens blank.

The invention also includes a method of packaging an optical lens blank for secure and safe storage, including, providing a lens box having at least inclined side gussets; inserting the lens blank in the box causing the lens blank side wall to contact and frictionally engage the gussets thereby restricting vertical and horizontal movement of the lens blank in the box; and closing the box.

15 Claims, 4 Drawing Sheets

LENS BOX

BACKGROUND OF THE INVENTION

1. Technical Field

The method and apparatus of the present invention relate generally to enclosing generally disc shaped objects for safe storage. More specifically, they relate to an apparatus and method for enclosing an optical lens blank with, the sides thereof frictionally engaged so as to prevent both horizontal or vertical movement of the lens blank in the enclosure during transportation.

Lens blanks are used as the starting material for corrective lenses in eyeglasses. These "generic" lens blanks are manufactured in bulk quantity by lens manufacturers without any particular refractive correction having basically a convex top, concave bottom and cylindrical side wall, which is ground to the proper correction later by the prescribing optician. Thus, the lens manufacturer is able to manufacture generic lens blanks in large production quantities. When a patient is treated and corrective lenses prescribed by an optometrist or other professional, an optician may then be employed to select the proper lens. In order to prevent the optician from having to maintain a very large supply of lenses all tailored to different prescriptions, the aforementioned lens blanks may be utilized. In that case, an optician would then select a generic lens blank and grind it to the required correction. With the large number of lenses being prescribed, there is obviously a large number of lens blanks being shipped from the manufactures to optical shops across the country.

In this system, the "generic" lens blanks have a convex top surface, a concave bottom and a generally cylindrical side wall. The lens blanks are designed and manufactured such that the convex top may remain in tact, the grinding occurring only to the bottom surface. Thus it is important that the convex top surface remain free of any scratches or other imperfections. Therefore, an important consideration in designing an enclosure box for transportation of such lens blanks is that any contact between the convex top surface of the lens blank and the shipping container must be prevented during shipment. Consequently, the shipping container must comprise a top surface spaced vertically from the lens blank convex top surface. Furthermore, the lens blank must be retained within the shipping enclosure such that vertical movement of the lens blank within the enclosure is prevented. One additional benefit of restricting movement on the lens blank is elimination of the annoying "rattling" that accompanies random movement of an unsecured object within a box.

2. Description of the Prior Art

Numerous examples exist of containers adapted to transport lenses and the like. One example of such prior art is Seger, U.S. Pat. No. 3,122,298, which discloses a container having slightly inclined sidewalls, handles, and a removable top. In the Seger enclosure, the inclination of the side walls is outwardly from the base upward. Thus, the Seger enclosure would not be operative to prevent vertical movement of the lens blank.

Another prior art example of a container is Buttery, U.S. Pat. No. 2,372,312, which discloses a folding octagon paper box having a general folding pattern and configuration for assembly of an octagonal container. Buttery does not have inclined sidewalls and thus would not be adapted to restrict vertical movement of the lens blank.

Towell, U.S. Pat. Nos. 1,968,660 and 1,968,661, show open topped display containers for candy and other confectionery having outwardly inclined side walls and no top to enclose the container.

Yet other prior art includes the use of styrofoam half sections to enclose lens blanks which are then manually inserted into a box enclosure for shipment.

Accordingly, it is a primary objective of the present invention to provide a lens blank box enclosure for transportation which is adapted to frictionally engage the lens blank side wall and hold it in position during shipment and transportation.

Another objective is to provide a lens blank enclosure box which is adapted to be fabricated from a single sheet of material.

Another objective is to provide a lens enclosure box wherein the lens may be fixed in position during transportation and wherein any physical contact of the lens blank top surface is avoided.

Another objective is to provide a lens enclosure box which has dust flaps positioned at box openings so as to greatly retard entry of dust into the box.

Another objective is to provide a lens enclosure box wherein the side walls thereof are made using a relatively flexible material so as to flex outwardly when engaged by the side walls of a lens blank having a diameter slightly larger than the enclosure.

SUMMARY OF THE INVENTION

The present invention includes a lens box for safe storage and transportation of optical lens blanks having vertically spaced apart top and bottom panels; two side walls, opposite closure panels and a plurality of gussets therebetween, all connected to the top and bottom panels and defining an enclosure space therebetween. The gussets are inclined upwardly and inwardly from the bottom panel, tangentially contacting the lens blank restricting the vertical and horizontal movement of the lens blank.

The invention also includes a method of packaging an optical lens blank for secure and safe storage, including, providing a lens box having at least inclined side gussets; inserting the lens blank in the box causing the lens blank side wall to contact and frictionally engage the gussets thereby restricting vertical and horizontal movement of the lens blank in the box; and closing the box.

DESCRIPTION OF THE PREFERRED EMBODIMENT

Lens blanks are used as the starting material for corrective lenses in eyeglasses. These "generic" lens blanks are manufactured in bulk quantity by lens manufacturers without any particular refractive correction having basically a convex top, concave bottom and cylindrical side wall, which is ground to the proper correction later by the prescribing optician. Thus, the lens manufacturer is able to manufacture generic lens blanks in large production quantities. When a patient is treated and corrective lenses prescribed by optometrist or other professional, an optician may then be employed to select the proper lens. In order to prevent the optician from having to maintain a very large supply of lenses all tailored to different prescriptions, the aforementioned lens blanks may be utilized. In that case, an optician would then select a generic lens blank and grind it to the required correction. With the large number of lenses being prescribed, the is obviously a large number of lens blanks being shipped from the manufactures to optical shops across the country.

In this system, the "generic" lens blanks have a convex top surface, a concave bottom and a cylindrical side wall. The lens blanks are designed and manufactured such that the convex top may remain in tact, the grinding occurring only to the bottom surface. Thus it is important that the convex top surface remain free of any scratches or other imperfections. Therefore, an important consideration in designing an enclosure box for transportation of such lens blanks is that any contact between the convex top surface of the lens blank and the shipping container must be prevented during shipment. Consequently, the shipping container must comprise a top surface space vertically from the lens blank convex top surface. Furthermore, the lens blank must be retained within the shipping enclosure such that vertical movement of the lens blank within the enclosure is prevented.

Figure 1:
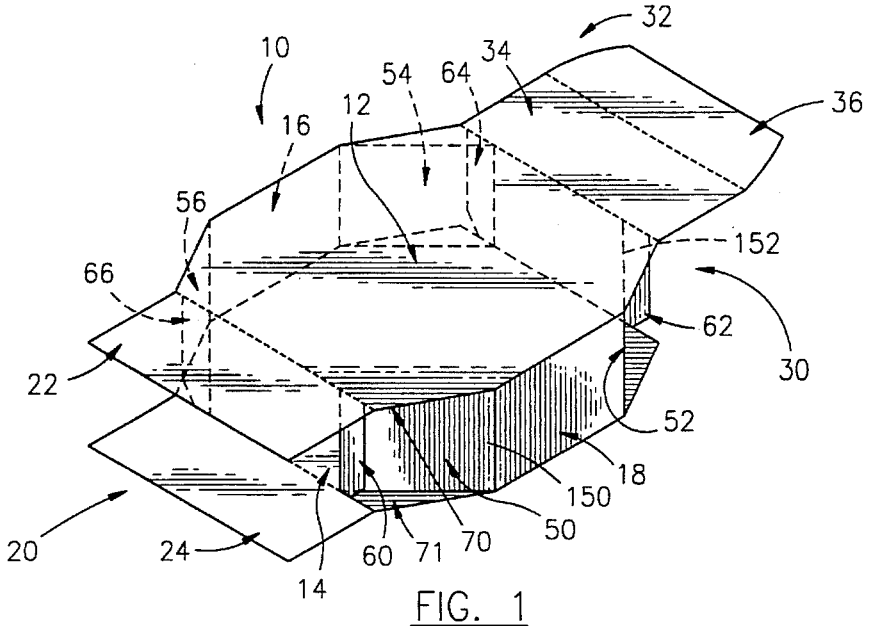
FIG. 1 is a perspective view showing the exterior feature of the lens blank enclosure box in the folded, enclosure configuration.

FIG. 1 is a perspective view of the lens enclosure box of the present invention in the folded, enclosure configuration. Box 10 comprises top panel 12, bottom panel 14 and side panels 16 and 18. Box 10 also comprises gussets 50, 52, 54, and 56 each sloped inwardly at the top and which are of special significance in the invention. The construction and function of the gussets discussed in more detail below. Finally, as shown in the figure, the enclosure box 10 comprises openings 20 and 30 at the opposite ends thereof. Openings 20 and 30 are a result of the preferred single sheet construction and allow for the slidable insertion of a lens blank 100 into the box. Dust flaps 60, 62, 64, and 66 in conjunction with closure flaps 22 and 24 and tuck closure 32 are adapted to seal openings 20 and 30. In the preferred embodiment and method of utilizing the enclosure box, is to close and seal opening 20 by machine during the box assembly procedure. Open end 30 would then be used for insertion of lens blank 100 at the lens manufacturer. Once lens blank 100 has been inserted, open end 30 would then be closed by hand.

Open end 20 is enclosed by means of upper closing flap 22 and lower closing flap 24. Upper closing flap 22 is foldably connected to box 10 top panel 12 while lower closure panel 24 is foldably connected to bottom panel 14. For closure of opening 20, dust flaps 60 and 66 would be pivoted outwardly until corresponding faces 160 and 166 are directed outwardly. Closure flap 24 would then be folded upwardly until it is vertical and in contact with faces 160 and 166 of dust panels 60 and 66. Closure flap 22 would then be folded downwardly into contact with panel 24. Adhesive, tape glue or the like would then be applied to keep panels 22 and 24 in place. Obviously suitable closure can also be made by first closing 22 and then 24. In the preferred embodiment, is used to secure the panels into position.

Opening 30 is closed by means of tuck closure 32. Tuck closure 32 comprises tuck panel 36 which is foldably connected to rectangular closure panel 34, which is in turn foldably connected to box top panel 12. Tuck panel 36 is adapted to be slidably inserted into the box, adjacent bottom panel 14. For closure of opening 30, dust flaps 62 and 64 would be pivoted outwardly so that faces 162 and 164 are directed outward. Closure 32 would then be pivoted downward until panel 34 contacts faces 162 and 164 of dust flaps 62 and 64 and until panel 36 is completely inserted.

Figure 8:
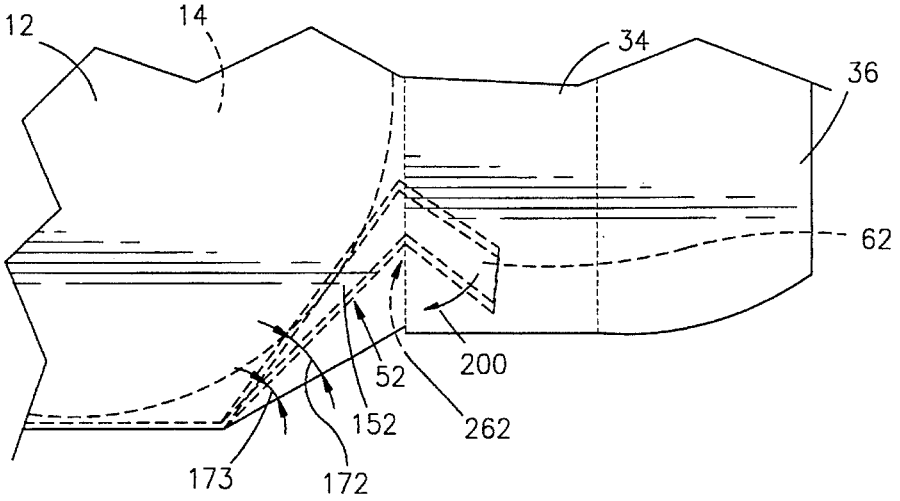
FIG. 8 is an enlarged partial sectional view showing one end of the enclosure box and illustrating in particular the different fold angles for the top and bottom gusset fold lines.
Figure 9:
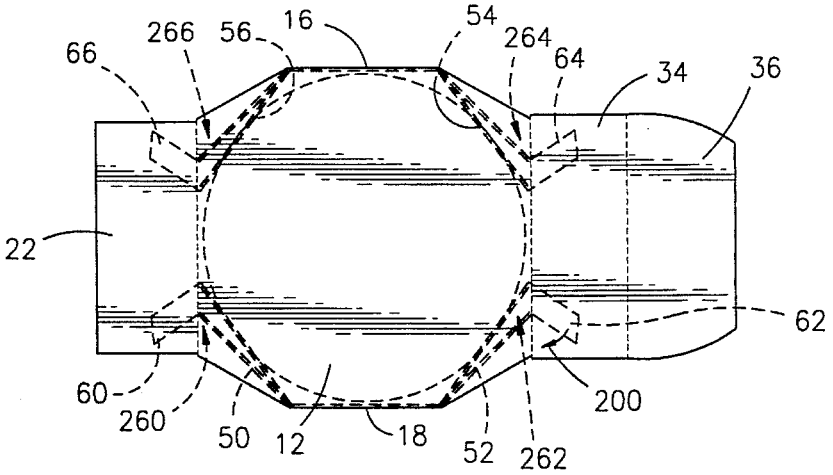
FIG. 9 is a top view of the enclosure box in the folded, enclosure configuration with the two ends opened.

Dust flaps 60, 62, 64, and 66 are foldably connected to inclined gussets 50, 52, 54, and 56, respectively as shown in the figures. The purpose of dust flaps 60, 62, 64, and 66 is to prevent dust from entering the box. Dust flaps 60, 62, 64, and 66 are adapted to fold outwardly into a position with faces 160, 162, 164, and 166 respectively, directed outwardly. When closure flaps 22 and 24 and tuck closure 32 are folded into the closure position as discussed above, dust flap faces 160, 162, 164, and 166 will lie in adjacent, abutting relation thereto, forming outwardly facing vertical troughs 260, 262, 264, and 266 as illustrated in FIGS. 8 and 9. These troughs provide a barrier, greatly inhibiting the introduction of any dust into the enclosure.

Figure 7:
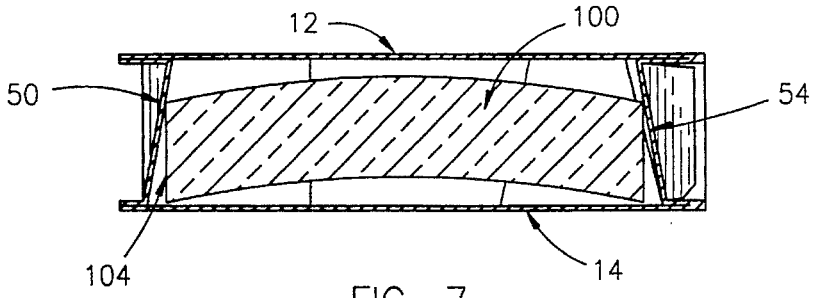
FIG. 7 is a sectional view taken along the lines shown in FIG. 6 showing the tangential contact of gussets and the lens blank side wall.

As mentioned above, a most important feature of the present invention is gussets 50, 52, 54, and 56 inwardly sloping at the top thereof. It is these gussets tangentially contact and frictionally engage the cylindrical side wall 104 of lens blank 100. This frictional engagement of the lens blank 100 side wall 104 by the gussets retains the lens blank in position preventing any substantial vertical or horizontal movement. Retention of a lens blank by these gussets is best shown in FIGS. 7.

Figure 2:
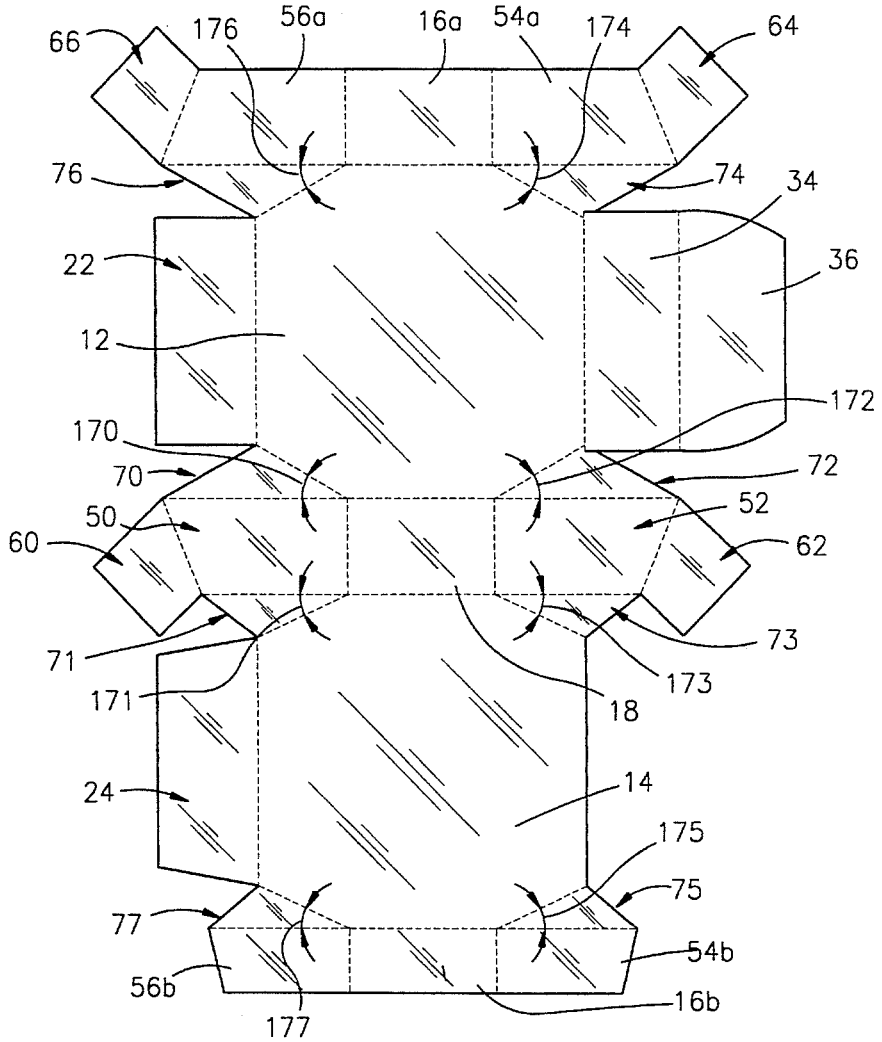
FIG. 2 is a top view showing the enclosure box in the flat, storage configuration.
Figure 3:
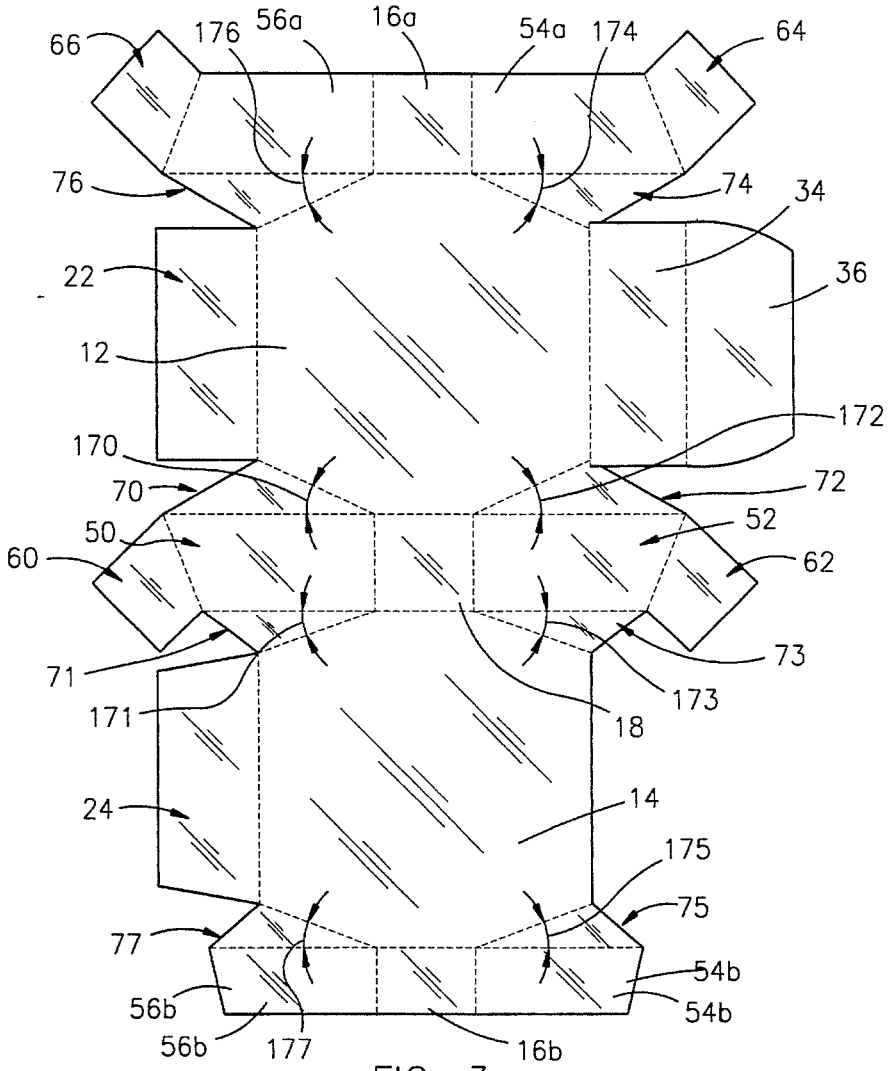
FIG. 3 is a top view showing the enclosure box in the flat, storage configuration having a slightly larger size and adapted to enclose a slightly larger lens blank than that shown in FIG. 2.

In the preferred embodiment, the enclosure box 10 of the present invention would be fabricated from a single sheet of material, as seen in FIGS. 2 and 3. In this embodiment the gussets 50 and 52 are foldably connected to side walls 16 and 18, and to top and bottom panels 16 and 44 through a series of triangular sections. Gussets 54 and 56 are foldably connected to top panel 12, side panel 16, and bottom panel 14. Gussets 50, 52, 54, and 56 could also be individually secured to box top and bottom panels. In either case, gussets 50, 52, 54, and 56 are positioned at a point on bottom panel 14 which is outwardly of that on top panel 12. Thus gussets 50, 52, 54, and 56 slope inwardly at the top portion thereof. It is this inwardly sloping feature of gussets 50, 52, 54, and 56 illustrated in FIG. 7, which cause them to tangentially contact and engage the top of lens blank 100 cylindrical side wall 104.

As mentioned, the preferred method of fabricating the lens enclosure box 10 is from a single sheet of material. In a preferred embodiment, 0.014 inch thickness solid bleached sulfate paperboard is used. It has been found that this material provides a good balance of rigidity for securing the lens blank but also some flexibility to accommodate blanks slightly larger than the diameter of box 10. Many other materials or folding carton stock and thicknesses may be utilized, depending on the use for the box, while still remaining within the scope of the invention. In the preferred embodiment, box 10 would be cut in the patterns indicated in FIGS. 2 or 3. FIG. 2 represents a box for smaller diameter lenses while the pattern of FIG. 3 is adapted for lenses with slightly larger diameters. The principal difference between the two alternatives illustrated is the horizontal dimension of side panels 16 and 18. This can be accomplished using the preferred method of box fabrication simply by shifting the location of the score (fold) lines. For purposes of illustration in FIG. 1 and the remaining figures, the larger diameter alternative illustrated in FIG. 3 will be used. However, all discussions are equally applicable to the diameter illustrated in FIG. 2. In fact, it is anticipated that several different sizes of boxes would be utilized corresponding generally to a small, medium, and large size. It is felt that these three sizes would be sufficient for the vast majority of lens blanks which are commercially manufactured. The fact that only three sizes of boxes would be required to accommodate such a large variety of diameters is due in part to the flexibility of the side walls 16 and 18 and gussets 50, 52, 54, and 56 and their ability to flex outwardly to accommodate a lens blank of slightly larger size. Also, by shifting the position of the score lines defining the dimension of the box side panels and gusset inclination angels, a single given box form can be used to accommodate numerous size lens blanks. For example by decreasing the size of side panels 16 and 18 and increasing the inclination of the gussets, the same enclosure box blank would accommodate relatively smaller blanks.

Preferably, box 10 would be cut from the paper board using the cutout form shown in the figures. Additionally, the paper board would be scored in the positions indicated by the dark lines indicating the lines on which the box is to be folded. In the preferred embodiment, the scoring is accomplished by impressing the fold line into the material. Alternatively, the score lines could be fabricated by perforating the paper board material along the lines or other suitable methods. The dimensions of the enclosure box and gusset angles may be varied simply by altering the position of the score lines during the box manufacture. When the box 10 is fabricated from a single sheet of material, as illustrated in FIGS. 2 and 3, an overlapping section must be provided for the securement of the device in the enclosed position. In the preferred embodiment, this overlapping section is provided by means of side panel 16*a* and *b* and gussets 56*a* and *b* and 54*a* and *b* as shown. When the pattern blank has been cut, the blank would be folded along the lines in FIG. 1. The flaps corresponding to gussets 56*a* and *b*, 54*a* and *b* and side panels 16*a* and *b* would then be overlapped slightly and some type of adhesive applied therebetween. Thus, the blank illustrated in FIGS. 2 and 3 may be folded together to form the enclosure illustrated in FIG. 1.

FIGS. 2 and 3 are particularly helpful in illustrating the preferred method of achieving the important inwardly sloping top of gussets 50, 52, 54, and 56. It will be observed from the figures that gussets 50, 52, 54, and 56 are foldably connected to the top and bottom panels by a series of triangular sections 70, 72, 74, and 76. It is the dimension and angular relation of these triangular sections panels which achieve the desired gusset inclination.

As shown in the figures especially FIGS. 2 and 3, gussets 50, 52, 54, and 56 are secured to top and bottom panels 12 and 14 by a series of triangular sections 70, 72, 74 and 76. For example, gusset 52 is connected to top panel 12 by triangular section 72 and to bottom panel 14 by triangular section 73. In the preferred embodiment, angle 172 between the fold lines defining the junction of top panel 12 and gusset 52 is greater than the angle 173 defining the junction of gusset 52 and bottom panel 14. When box 10 is folded into position as indicated in FIG. 1, triangular sections 72 and 73 assume a generally horizontal position with section 72 being adjacent top panel 12 and section 73 being adjacent bottom panel 14. Thus, in the folded position, angles 173 and 172 define inwardly directed angles. Since the greater angle, 172, is associated with the top triangular section 72, gusset 52 will be inclined inwardly at the top panel 12 relative to the bottom panel 14. Thus, when box 10 is folded from the flat storage configuration illustrated in FIGS. 2 or 3, into the enclosure configuration of FIG. 1, gussets 52, 54, and 56 will incline inwardly at top panel 12.

Figure 4:
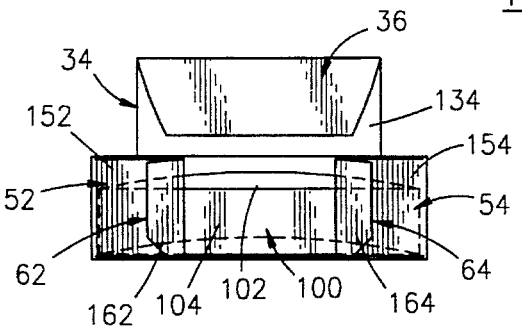
FIG. 4 is a cross-sectional end view showing the enclosure box in the folded, enclosure configuration with a lens blank inserted therein.

FIG. 4 is an end view showing the lens enclosure box 10 of the present invention with a lens blank 100 inserted therein. As previously described, the preferred assembly method is to close end 20 and insert blank 100 through opening 30. As can be seen in the figure, the vertical height of the box 10 is greater than that of the lens blank 100. This is done in order to prevent contact with convex top 102 of lens blank 100. As discussed earlier, it is standard technique to manufacture generic lens blanks for shipment to opticians. Once a prescription has been determined, the optimum would take the "generic" blank and grind it to the proper prescription. This is done by grinding only the concave bottom surface, leaving the convex top surface 102 intact. Thus it is of critical importance that this convex top surface 102 not be exposed to any physical contact with the shipping container during transportation which might result in scratches on the top surface. Consequently contact between convex top surface 102 and the box should be avoided.

Also clearly illustrated in this figure are the dust flaps 62 and 64. As shown in the figure, dust flaps 62 and 64 are foldably connected to gussets 52 and 54 respectively. The foldable connection between dust flaps 62 and 64 and gussets 52 and 54, respectively, allow flaps 62 and 64 to be pivoted outwardly of the enclosure box 10 for sealing purposes and to inhibit the introduction of dust into container 10 as much as possible. Dust flaps 62 and 64 would be pivoted outwardly until reaching a nearly parallel orientation with the gussets, with faces 162 and 164 facing outwardly as shown. Tuck closure 32 which is foldably connected to box top panel 12, would be pivoted downwardly and tuck panel 36 would be slidably engaged with and received along the inside surface of bottom panel 14. This causes the interior surface 134 of closure panel 34 and faces 162 and 164 of dust flaps 62 and 64 to be positioned in adjacent and abutting relation with one another and generally continuous physical contact therewith. Thus, a generally vertical trough is formed between the dust flap and associated gusset. This dust-inhibiting feature of closure panel 34, gussets 52 and 54 and dust flaps 62 and 64 is illustrated in the side view of FIG. 8. As seen in the figure, gusset 54 and dust flap 64 form an outwardly facing vertical trough to inhibit the introduction of dust into the container. A similar outwardly facing vertical trough is formed at the other end of the container by gusset 56 and the foldably connected dust flap 66 and gusset 50 and dust flap 60.

Figure 5:
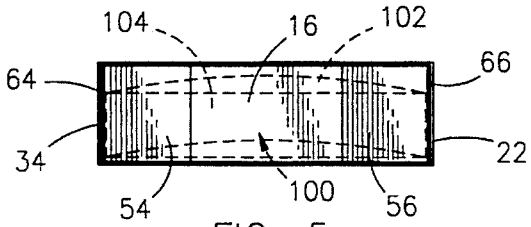
FIG. 5 is a side view of the enclosure box showing in hidden lines, a lens blank installed therein.

FIG. 5 is a side view of the enclosure box in the completely closed configuration showing, in hidden lines, lens blank 100 installed therein. As seen in the figure, box 10 is of sufficient vertical height so as to permit lens blank 100 to sit therein without the convex top portion 102 of lens blank 100 contacting box top panel 12. As discussed elsewhere, this is an important consideration since lens blank 100 is designed for use of top 102 in the final eyeglass lens and thus must be kept in pristine condition.

Figure 6:
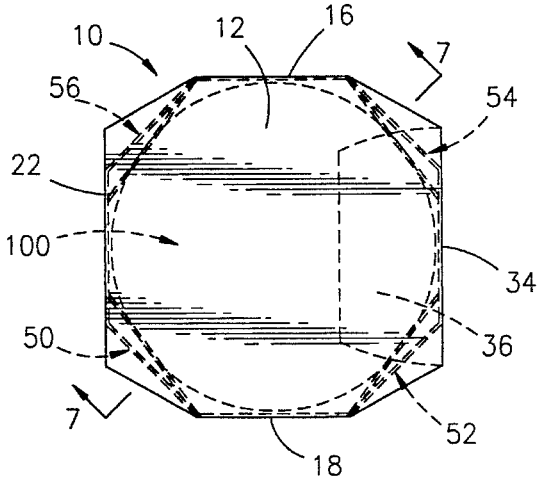
FIG. 6 is a top view of the enclosure box showing, in hidden lines, a lens blank installed therein and the gussets holding the blank.

FIGS. 6 and 7 are top and side sectional views of the lens enclosure box showing in hidden lines lens blank 100 and gussets 50, 52, 54, and 56. As can be seen in the figures, gussets 50, 52, 54, and 56 are adapted to frictionally engage lens blank 100 at four points around the blank. As illustrated more clearly in FIG. 7, gussets 50, 52, 54, and 56 are adapted to tangentially engage lens blank 100 at the top of cylindrical side wall 104. Also seen in FIG. 7 is the spaced relation between top convex portion 102 and box top panel 12.

FIG. 8 is an enlarged top view of open end 30 of the enclosure apparatus of the present invention illustrating in particular the inward inclination of gusset 52. While only one gusset is illustrated and discussed here, the discussion applies equally to the remaining gussets. As discussed above, when folded into position as indicated in FIG. 1, triangular sections 72 and 73 (FIGS. 2 and 3) assume a generally horizontal position, with section 72 being adjacent top panel 12 and section 73 being adjacent bottom panel 14. Thus, when folded, angles 173 and 172 define inwardly directed angles as shown in the figure. Since the greater angle 172 is associated with the top triangular section 72, gusset 52 will be inclined inwardly at the top panel 12 relative to the bottom panel 14. Thus, when box 10 is folded from the flat storage configuration illustrated in FIGS. 2 or 3, into the enclosure configuration of FIG. 1, gussets 50, 52, 54, and 56 will incline inwardly at top panel 12. This outwardly placement of gusset 52 bottom panel 14 relative to top panel 12 is further illustrated in the figure by the appearance of face 152 of gusset 52 which would otherwise be perpendicular to the plane view. Also shown in FIG. 8 is the dust flap 62 foldably connected to gusset 52. As shown by the movement arrow 200, dust flap 62 is adapted to be pivoted outwardly so as to lie in the plane of opening 30. Thus, when tuck closure 32 is inserted into opening 30, interior face 134 of closure panel 34 will contact the outward face 162 of dust panel 62 forming the aforementioned vertical trough 262, and providing the dust entry inhibiting orientation discussed above. Similar adjacent placement applies to the remaining dust flaps and associated closure flaps.

FIG. 9 is a top view of the container apparatus 10 of the present invention showing in sectional view the placement of gussets 50, 52, 54, and 56 and their associated dust flaps 60, 62, 64, and 66. As illustrated in the earlier figures and discussed above, dust flaps 60, 62, 64, and 66 are adapted to be pivoted outwardly as indicated for example by arrow 200 such that they lie flat and approximately in the plane of the container openings 20 and 30 (FIG. 1). When tuck closure 32 is closed, faces 162 and 164 of dust flaps 62 and 64 are brought into abutting relation with tuck closure panel 34. Similarly, faces 160 and 166 of dust flaps 60 and 66 are brought into abutting relation with closure flaps 22 and 24. Dust flaps 60, 62, 64, and 66 and gussets 50, 52, 54, and 56 thus form outwardly facing vertical troughs 260, 262, 264, and 266.

Figure 11:
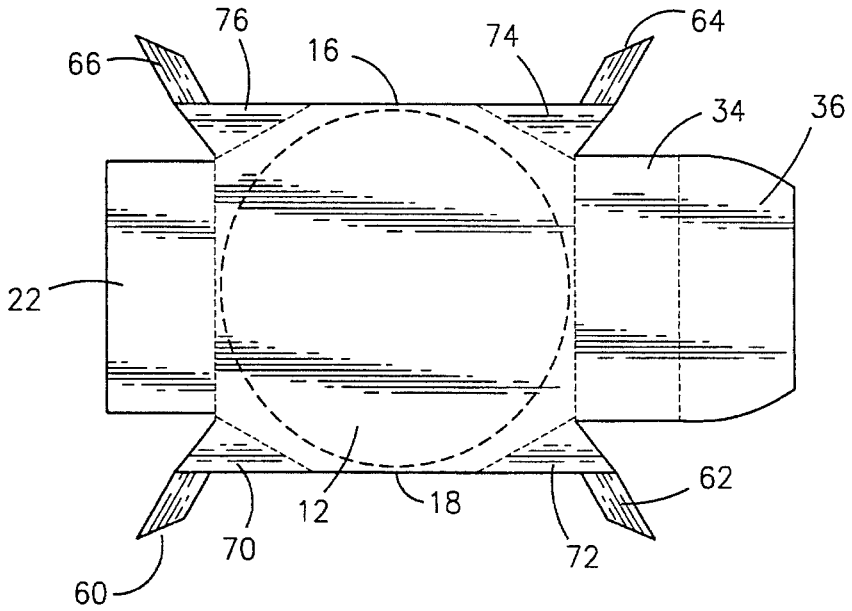
FIG. 11 is a top view of the enclosure box in the partially closed configuration with the ends opened and with the gussets and dust flaps opened.

FIG. 11 illustrates the position of gussets 50, 52, 54, and 56 and associated dust flaps in the outward position. In order to complete construction of the box, gussets 50 and 56 and associated dust flaps, would be pressed inwardly to the position indicated in FIG. 9. Closure flaps 22 and 24 would then be closed and secured as described above. A lens blank would then be inserted in open end 30 and gussets 52 and 54 and associated dust flaps closed as indicated in FIG. 9. Enclosure is then completed by inserting tuck closure 32 in open end 30 with tuck panel 36 adjacent bottom panel 14.

Figure 10:
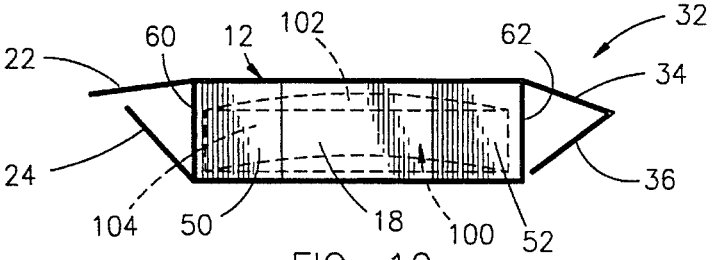
FIG. 10 is a side view of the enclosure box showing the closure means for the two open box ends, and in hidden lines, a lens blank installed therein.
Figure 12:
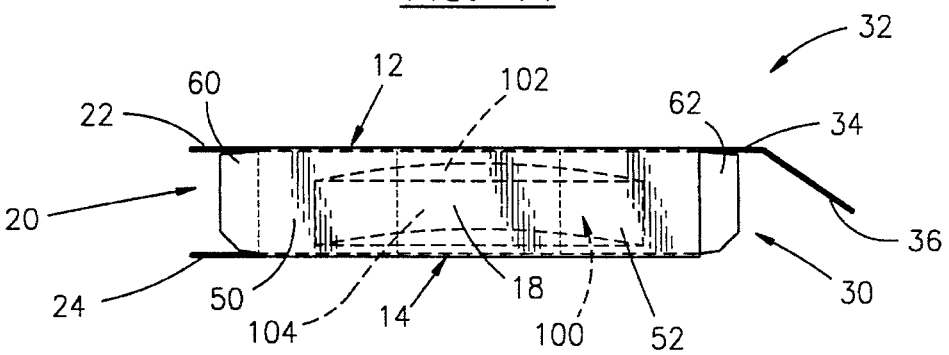
FIG. 12 is a side view of the enclosure box in the partially folded, enclosure configuration shown in FIG. 11, showing the lens blank in hidden lines.
Figure 13:
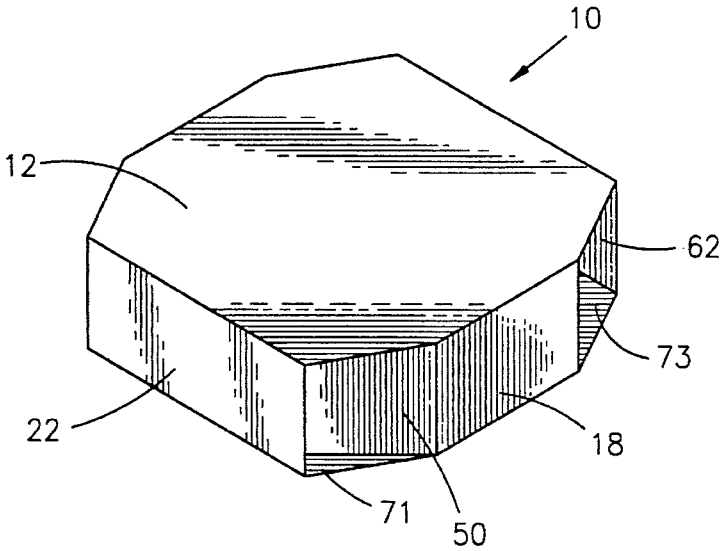
FIG. 13 is a perspective view of the enclosure box in the completely closed position.

FIG. 10 and 12 are side views of the enclosure apparatus of the present invention showing in particular the orientation of the closure means used to close openings 20 and 30. As seen in the figures, opening 20 is adapted to be closed using upper closing panel 22 and lower closing panel 24. In the preferred embodiment, dust flaps 60 and 66 would be pivoted outwardly and parallel to opening 20 such that their faces 160 and 166 would be oriented outwardly of box 10 for contact with closure panel 22 or 24. Lower closing panel 24 would then be pivoted upwardly until reaching a generally vertical orientation and such that it contacts front faces 160 and 166 of dust flaps 60 and 66. Upper closing panel 22 would then be pivoted downwardly, also reaching a generally vertical orientation and an abutting relation to lower closing panel 24. It is not important which of the two closure panels 22 or 24 is moved into position first. Sealing means such as glue, tape or the like would then be used to secure the lower and upper closing panels in position.

Opening 30 is adapted to be closed using tuck closure 32 which comprises tuck panel 36 foldably connected to closure panel 34 which is in turn foldably connected to top panel 12. To close opening 30, tuck closure 32 would be pivoted downwardly until tuck panel 36 is slidably received along and adjacent the inner surface of bottom panel 14 bringing closure panel 34 into a generally vertical position and in contact outwardly pivoted with faces 162 and 164 of dust flaps 62 and 64. Thus, the enclosure box openings 20 and 30 may be sealed using closing panels 22 and 24 and tuck closure 32 which in conjunction with dust flaps 60, 62, 64, and 66 provide a means for both sealing the box and inhibiting the introduction of dust therein.

It is obvious that numerous other modifications and variations of the present invention are possible in view of the above teachings. For example, the means by which gussets 50, 52, 54, and 56 are attached to the top and bottom panels 12 and 14, respectively, may be accomplished by various methods while still retaining the inwardly sloping design taught herein. Additionally, different thicknesses and types of material may be used in constructing the box, thus altering the rigidity of side walls 16 and 18 and gussets 50, 52, 54, and 56 so as to accommodate different sizes of objects for transportation. Further, it is clear that the box disclosed herein is not limited to the transportation of lens blanks only. Rather the enclosure would be useful for any cylindrical object of suitable size. Therefore, it is to be understood that the above description is intended in no way to limit the scope of protection of the claims and is representative of only one of several possible embodiments of the present invention.

Thus there has been shown and described an invention which accomplishes at least all of the stated objectives.

We claim:

1. A lens box for safe storage and transportation of an optical lens blank having convex top and concave bottom surfaces and a cylindrical side wall, the junction of said top and bottom surfaces with said side wall defining a top ridge and a bottom ridge, comprising:

vertically spaced apart, substantially parallel top panel and bottom panel;

horizontally spaced apart, substantially parallel first and second side walls, said side walls being generally perpendicularly connected to said top and bottom panels;

a plurality of gussets, each of said gussets being connected to said top and bottom panels thereby defining an interior generally enclosed space between said top and bottom panels, said side walls and said gussets, each gusset and said top panel further defining an interior angle and an exterior angle and each gusset and said bottom panel further defining an interior angle and an exterior angle and wherein said interior angle between each gusset and said top panel being greater than said interior angle between that same gusset and said bottom panel such that said gussets are inclined upwardly and inwardly from said bottom panel such that upon insertion of a said lens blank into said lens box, said gussets tangentially contact said lens blank top ridge at a point corresponding to the intersection of said lens blank side wall and said gussets thereby securing said lens blank against any substantial horizontal and vertical movement in said box.

2. The invention of claim 1 further comprising dust flaps.

3. The invention of claim 1 wherein said box is formed from a single sheet of material.

4. The invention of claim 1 wherein said top and bottom panels extend beyond said gussets.

5. The invention of claim 4 wherein each of said gussets is connected to said top and bottom panels by a top and bottom connecting triangle section respectively, each of said triangle sections being foldably connected along respective fold lines to a respective one of said gussets and said respective top or bottom panel at the hypotenuse of said triangle section, the angle between said fold lines connecting said gusset and said top panel to said top triangle section being greater than the angle between the fold lines connecting said gusset and said bottom panel to said bottom triangle section such that said gussets are inclined upwardly and inwardly at said top panel and such that upon said lens blank being inserted into said lens box, said gussets tangentially contact said lens blank top ridge at a point corresponding to the intersection of said lens blank side wall and said gussets.

6. The invention of claim 5 wherein said fold lines are scored by perforating said sheet of material along said fold lines.

7. The invention of claim 5 wherein said fold lines are scored by impressing said sheet of material at the point of folding.

8. The invention of claim 1 wherein said material is unbleached sulfate paperboard.

9. The invention of claim 1 wherein said gussets are adapted to flex outwardly in response to pressure from said lens blank top ridge such that said lens box of a single size is capable of accommodating lens blanks having differing diameters and thicknesses.

10. The invention of claim 1 further comprising closure flaps.

11. In combination;

an optical lens blank having convex top and concave bottom surfaces and a cylindrical side wall, the junction of said top and bottom surfaces with said side wall defining top and bottom ridges respectively; and a lens box for safe storage and transportation of said optical lens blank during transportation, by tangentially contacting said top ridge, said box having;

vertically spaced apart, substantially parallel top and bottom panels;

horizontally spaced apart, substantially parallel first and second side walls said side walls being generally perpendicularly connected to said top and bottom panels;

a plurality of gussets, each of said gussets being connected to said top and bottom panels thereby defining an interior generally enclosed space between said top and bottom panels, said side walls, and said gussets, each gusset and said top panel further defining an interior angle and an exterior angle and each gusset and said bottom panel further defining an interior angle and an exterior angle and wherein said interior angle between each gusset and said top panel being greater than said interior angle between that same gusset and said bottom panel such that said gussets are inclined inwardly and upwardly from said bottom panel, said lens blank being positioned in said lens box with said gussets in tangential contact with said lens blank top ridge at points corresponding to the intersections of said lens blank side wall and said gussets thereby securing said lens blank against any substantial horizontal and vertical movement of said lens blank in said box.

12. A box for safe storage and transportation of a cylindrical object, the cylindrical object having top and bottom surfaces and a generally cylindrical side wall, the junction of said top and bottom surfaces with said side wall defining a top ridge and a bottom ridge by tangentially contacting said top ridge, comprising:

vertically spaced apart, substantially parallel top and bottom panels;

horizontally spaced apart, substantially parallel first and second side walls said side walls being perpendicularly connected to said top and bottom panels;

a plurality of gussets, each of said gussets being connected to said top and bottom panels thereby defining an interior enclosed space between said top and bottom panels, said side walls and said gussets, each gusset and said top panel further defining an interior angle and an exterior angle and each gusset and said bottom panel further defining an interior angle and an exterior angle and wherein said interior angle between each gusset and said top panel being greater than said interior angle between that same gusset and said bottom panel such that said gussets are inclined upwardly and inwardly from said bottom panel such that upon a said cylindrical object being inserted into said box, said gussets tangentially contact said cylindrical object top ridge at a point corresponding to the intersection of said cylindrical object side wall and said gussets thereby securing said cylindrical object against any substantial horizontal and vertical movement in said box.

13. A method of packaging an optical lens blank for secure and safe storage, the lens blank having convex top and concave bottom surfaces and a cylindrical side wall, the junction of said top and bottom surfaces with said side wall defining a top ridge and a bottom ridge respectively, by tangentially contacting said top ridge, comprising:

providing a lens box having:

vertically spaced apart, substantially parallel top and bottom panels;

horizontally spaced apart, substantially parallel first and second side walls said side walls being perpendicularly connected to said top and bottom panels;

a plurality of gussets, each of said gussets being connected to said top and bottom panels thereby defining an interior enclosed space between said top and bottom panels, said side walls and said gussets, each gusset and said top panel further defining an interior angle and an exterior angle and each gusset and said bottom panel further defining an interior angle and an exterior angle and wherein said interior angle between each gusset and said top panel being greater than said interior angle between that same gusset and said bottom panel such that said gussets are inclined inwardly at said top panel and such that when a said lens blank is inserted into said lens box said gussets tangentially contact said lens blank top ridge at a point corresponding to the intersection of said lens blank side wall and said gussets;

inserting said lens blank in said box by placing said concave bottom surface adjacent said bottom panel thereby causing said lens blank side wall to contact and frictionally engage said gussets thereby retaining said lens blank in position and preventing any substantial horizontal or vertical movement of said lens blank in said box; and closing said box.

14. The method of claim 13 wherein the step of providing a lens box includes the steps of:

providing a box formed from a single sheet of paperboard having preformed score lines to indicate fold lines operative to facilitate transformation of said box from a flat storage configuration to a folded, enclosure configuration, said box further comprising a sealing flap operative to provide a means for sealing said box in said enclosure configuration; and forming said container by folding said single sheet of paperboard along said preformed score lines thereby transforming said box to said enclosure configuration from said storage configuration.

15. The method of claim 14 wherein the step of providing a lens box further comprises the step of positioning said fold score lines so as to accommodate the diameter and height of said lens blank.

* * * * *